US010054099B2

(12) United States Patent
Zheng et al.

(10) Patent No.: US 10,054,099 B2
(45) Date of Patent: Aug. 21, 2018

(54) MULTI-COIL SPARK IGNITION SYSTEM

(71) Applicant: Ming Zheng, Windsor (CA)

(72) Inventors: Ming Zheng, Windsor (CA); Shui Yu, Windsor (CA); Kelvin Xie, Windsor (CA)

(73) Assignee: Ming Zheng, Windsor (CA)

( * ) Notice: Subject to any disclaimer, the term of this patent is extended or adjusted under 35 U.S.C. 154(b) by 258 days.

(21) Appl. No.: 15/238,886

(22) Filed: Aug. 17, 2016

(65) Prior Publication Data

US 2016/0356258 A1 Dec. 8, 2016

Related U.S. Application Data

(62) Division of application No. 13/917,054, filed on Jun. 13, 2013, now Pat. No. 9,441,604.

(Continued)

(51) Int. Cl.

| | |
|---|---|
| ***H01T 13/46*** | (2006.01) |
| ***H01T 13/22*** | (2006.01) |
| ***F02P 7/10*** | (2006.01) |
| ***F02P 3/04*** | (2006.01) |
| ***F02P 15/10*** | (2006.01) |

(Continued)

(52) U.S. Cl.

CPC ..... *F02P 7/10* (2013.01); *F02D 35/021* (2013.01); *F02P 3/04* (2013.01); *F02P 9/002* (2013.01); *F02P 15/10* (2013.01); *H01T 13/22* (2013.01); *H01T 13/46* (2013.01); *H01T 13/467* (2013.01)

(58) Field of Classification Search

CPC ..... H01T 13/22; H01T 13/46; H01T 13/467

See application file for complete search history.

(56) References Cited

U.S. PATENT DOCUMENTS 1,033,449 A * 7/1912 Murray ..... H01T 13/22 174/105 R 1,191,429 A * 7/1916 Jensen ..... H01J 61/72 123/169 E (Continued)

*Primary Examiner* — Scott Bauer

(74) *Attorney, Agent, or Firm* — Aventum IP Law LLP

(57) ABSTRACT

An igniter for a spark ignition system includes a support body fabricated from an electrically insulating material and a metal casing disposed outwardly of and at least partially surrounding the support body. The metal casing has a structure for connecting the metal casing to ground. At least two rod-shaped first electrodes are supported one relative to another by the support body and are electrically isolated one from the other by the support body. Each first electrode has a first end that protrudes from a first end of the support body at a spark forming end of the igniter. The support body is disposed at least partly within an axial channel of a generally cylindrically-shaped second electrode. The second electrode projects past the support body at the spark forming end of the igniter and cooperates with the first ends of the at least two first electrodes to define at least two spark gaps. The second electrode is electrically isolated from the metal casing by an air gap. During use the first electrodes receive a first voltage that is higher than ground and the second electrode receives a second voltage that is lower than the first voltage. A first spark is formed within a first one of the at least two spark gaps and a second spark is formed within a second one of the at least two spark gaps.

17 Claims, 9 Drawing Sheets

Related U.S. Application Data

(60) Provisional application No. 61/702,469, filed on Sep. 18, 2012.

(51) Int. Cl.
*F02P 9/00* (2006.01)
*F02D 35/02* (2006.01)

(56) References Cited

U.S. PATENT DOCUMENTS 1,363,904 A * 12/1920 Nicholson ..... H01T 13/22
123/169 CB
1,381,167 A * 6/1921 De Clairmont ..... H01T 13/462
123/169 CA
1,624,785 A * 4/1927 Fuchs ..... H01T 13/22
313/123
3,567,987 A * 3/1971 Schnurmacher ..... H01T 13/462
313/123
4,004,562 A * 1/1977 Rado ..... H01T 13/462
123/169 EL
7,098,581 B2 * 8/2006 Cleeves ..... H01T 13/462
313/123

* cited by examiner

Fig. 3a
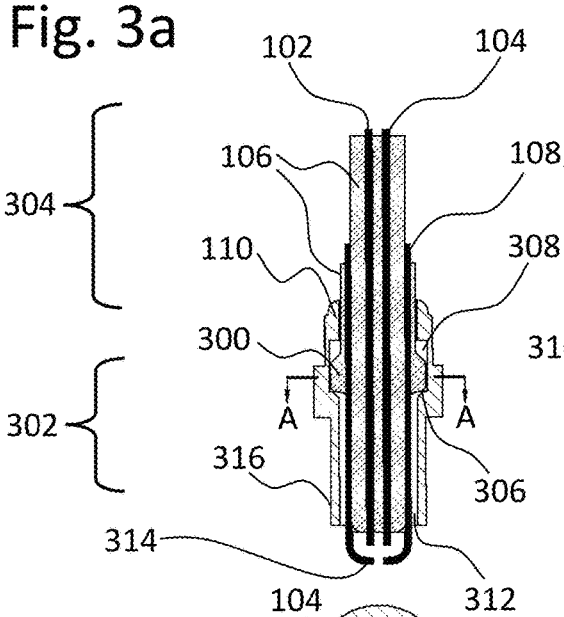
Fig. 3b
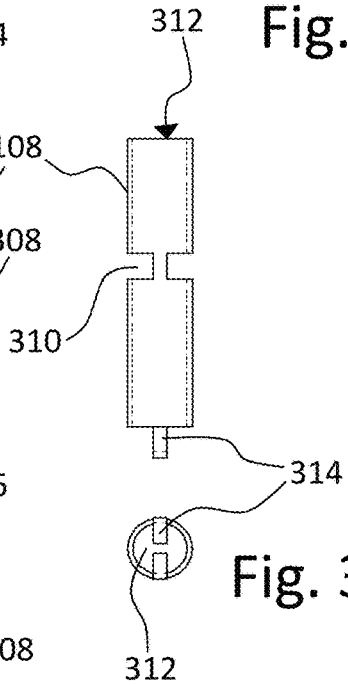
Fig. 3c
Fig. 3d
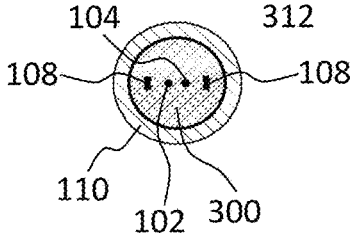

MULTI-COIL SPARK IGNITION SYSTEM

This application is a division of U.S. patent application Ser. No. 13/917,054 filed on Jun. 13, 2013, which claims priority from U.S. Provisional Application 61/702,469 filed on Sep. 18, 2012 and incorporates the disclosure of each application in their entirety by reference.

FIELD OF THE INVENTION

The present invention relates generally to spark ignition systems. More particularly, the present invention relates to multi-coil spark ignition systems for internal combustion engines and to methods for generating multiple sparks at one spark event and/or for controlling spark events based on feedback signals.

BACKGROUND OF THE INVENTION

In a spark ignition system an igniter, such as for instance a spark plug, is used to ignite an air-fuel mixture within a combustion zone. It is desirable to dilute the combustible mixture by increasing the air/fuel ratio, or by increasing the level of exhaust gas recirculation (EGR), which enables operation at higher compression ratios and loads and achieves cleaner and more efficient combustion. Unfortunately, operation at these increased dilution levels gives rise to problems relating to both ignition and flame propagation, necessitating the use of a robust ignition source to ensure successful ignition and stable combustion.

Additional problems are encountered in engines that have a stratified in-cylinder charge and strong charge motion. Under such conditions a long sparking duration is used so as to increase the probability of catching the optimum mixture pocket near the igniter, thereby improving ignition reliability. It has been reported that a longer duration spark with low peak current has better ignition properties than a shorter duration spark with higher peak current under the enhanced charge motion condition.

It would be beneficial to provide a spark ignition system and related methods that achieve reliable combustion results at lean and/or EGR cylinder charges below the limits that are currently encountered.

SUMMARY OF THE INVENTION

In accordance with an aspect of the invention, a spark ignition system is provided comprising igniters (e.g., spark plugs) with plural high-voltage (HV) electrodes, either positive or negative. The spark ignition system further comprises a coil assembly having plural ignition coils to manage the spark discharge process, and multiple isolated high-tension cables to deliver energy from the ignition coils to the igniter. The spark ignition system is suitable for improving ignition quality by using one or more of the following approaches:

1) Enlarge the spark kernel.

2) Provide multiple discharge channels.

3) Prolong the discharge duration.

4) Generate turbulence around the spark gap to promote the combustion speed at the early stage of combustion.

5) Produce radical species to promote chemical reaction at the early stage of combustion.

In accordance with an aspect of an embodiment of the invention, there is provided an ignition system for an internal combustion engine, comprising: an igniter having at least two high voltage (HV) electrodes and a low voltage (LV) electrode, the at least two HV electrodes being electrically isolated one from the other and the at least two HV electrodes being electrically isolated from the LV electrode; a coil assembly having at least one primary winding and at least two secondary windings, each secondary winding having a terminal for providing a HV signal; a driver module for energizing the coil assembly; and a high tension cable comprising at least two resistive wires, each one of the at least two resistive wires connecting one of the at least two HV electrodes to the terminal of one of the at least two secondary windings, and the high tension cable further comprising a non-resistive wire connecting the LV electrode to the driver module.

In accordance with an aspect of an embodiment of the invention, there is provided a method, comprising: providing an ignitable fuel mixture in a combustion zone; providing a multi-electrode igniter in communication with the combustion zone, the multi-electrode igniter comprising at least two high voltage (HV) electrodes and a low voltage (LV) electrode, each one of the at least two HV electrodes connected to a different secondary winding of a coil assembly; using a driver module, energizing and discharging the coil assembly to provide an HV signal to each one of the at least two HV electrodes; producing a plurality of sparks within the combustion zone based on the HV signals that are sent to each one of the at least two HV electrodes; generating a feedback signal based on at least one of a sensed spark discharge current and a sensed combustion ion current within the combustion zone; providing the feedback signal to a feedback circuit of the driver module; and based on the feedback signal, adjusting a parameter for energizing and discharging of the coil assembly.

In accordance with an aspect of an embodiment of the invention, there is provided an igniter for a spark ignition system, comprising: a support body fabricated from an electrically insulating material; a metal casing disposed outwardly of and at least partially surrounding the support body, the metal casing having a structure for connecting the metal casing to ground; at least two rod-shaped high voltage (HV) electrodes supported one relative to another by the support body and electrically isolated one from the other by the support body, each HV electrode of the at least two HV electrodes having a first end that protrudes from a first end of the support body at a spark forming end of the igniter; and a generally cylindrically-shaped low voltage (LV) electrode having an axial channel, the support body being disposed at least partly within the axial channel, the LV electrode projecting past the support body at the spark forming end of the igniter and cooperating with the first ends of the at least two HV electrodes to define at least two spark gaps, the LV electrode further being electrically isolated from the metal casing by an air gap; wherein during use a first spark is formed within a first one of the at least two spark gaps and a second spark is formed within a second one of the at least two spark gaps.

In accordance with an aspect of an embodiment of the invention, there is provided an igniter for a spark ignition system, comprising: a support body fabricated from an electrically insulating material; a metal casing disposed outwardly of and at least partially surrounding the support body, the metal casing having a structure for connecting the metal casing to ground; at least two high voltage (HV) electrodes and a low voltage (LV) electrode, the at least two HV electrodes being electrically isolated one from the other and from the LV electrode, each one of the at least two HV electrodes and the LV electrode being a generally rod-shaped electrode supported by the support body and each one of the at least two HV electrodes and the LV electrode having a first end that protrudes from the support body at the spark forming end of the igniter, wherein the at least two HV electrodes and the LV electrode are disposed one relative to another and protrude from the support body by a distance that is sufficient to form, during a spark event, a plurality of sparks there between. The HV and LV electrodes are bonded to the support body with sufficient mechanical strength to withstand the high pressure in the combustion zone.

In accordance with an aspect of an embodiment of the invention, there is provided an igniter for a spark ignition system, comprising: a support body fabricated from an electrically insulating material; a metal casing disposed outwardly of and at least partially surrounding the support body, the metal casing having a structure for connecting the metal casing to ground; at least two rod-shaped first electrodes supported one relative to another by the support body and electrically isolated one from the other by the support body, each first electrode of the at least two first electrodes having a first end that protrudes from a first end of the support body at a spark forming end of the igniter; and a generally cylindrically-shaped second electrode having an axial channel, the support body being disposed at least partly within the axial channel, the second electrode projecting past the support body at the spark forming end of the igniter and cooperating with the first ends of the at least two first electrodes to define at least two spark gaps, the second electrode further being electrically isolated from the metal casing by an air gap; wherein during use the first electrodes receive a first voltage that is higher than ground and the second electrode receives a second voltage that is lower than the first voltage; and wherein during use a first spark is formed within a first one of the at least two spark gaps and a second spark is formed within a second one of the at least two spark gaps.

In accordance with an aspect of an embodiment of the invention, there is provided an igniter for a spark ignition system, comprising: a support body fabricated from an electrically insulating material; a metal casing disposed outwardly of and at least partially surrounding the support body, the metal casing having a structure for connecting the metal casing to ground; at least two first electrodes and a second electrode, the at least two first electrodes being electrically isolated one from the other and from the second electrode, each one of the at least two first electrodes and the second electrode being a generally rod-shaped electrode supported by the support body and each one of the at least two first electrodes and the second electrode having a first end that protrudes from the support body at the spark forming end of the igniter, wherein during use the first electrodes receive a first voltage that is higher than ground and the second electrode receives a second voltage that is lower than the first voltage; and wherein the at least two first electrodes and the second electrode are disposed one relative to another and protrude from the support body by a distance that is sufficient to form, during a spark event, a plurality of sparks therebetween.

BRIEF DESCRIPTION OF THE DRAWINGS

The instant invention will now be described by way of example only, and with reference to the attached drawings, wherein similar reference numerals denote similar elements throughout the several views, and in which:

FIG. 3*a* is a simplified cross-sectional diagram of an igniter having plural rod-shaped high voltage (HV) electrodes and a cylindrical-shaped low voltage (LV) electrode.

FIG. 3*b* is a simplified side view showing a cylindrical-shaped LV electrode.

FIG. 3*c* is an end view of the cylindrical-shaped LV electrode of FIG. 3*b*.

FIG. 3*d* is a cross-sectional view taken along the line A-A in FIG. 3*a*.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1:
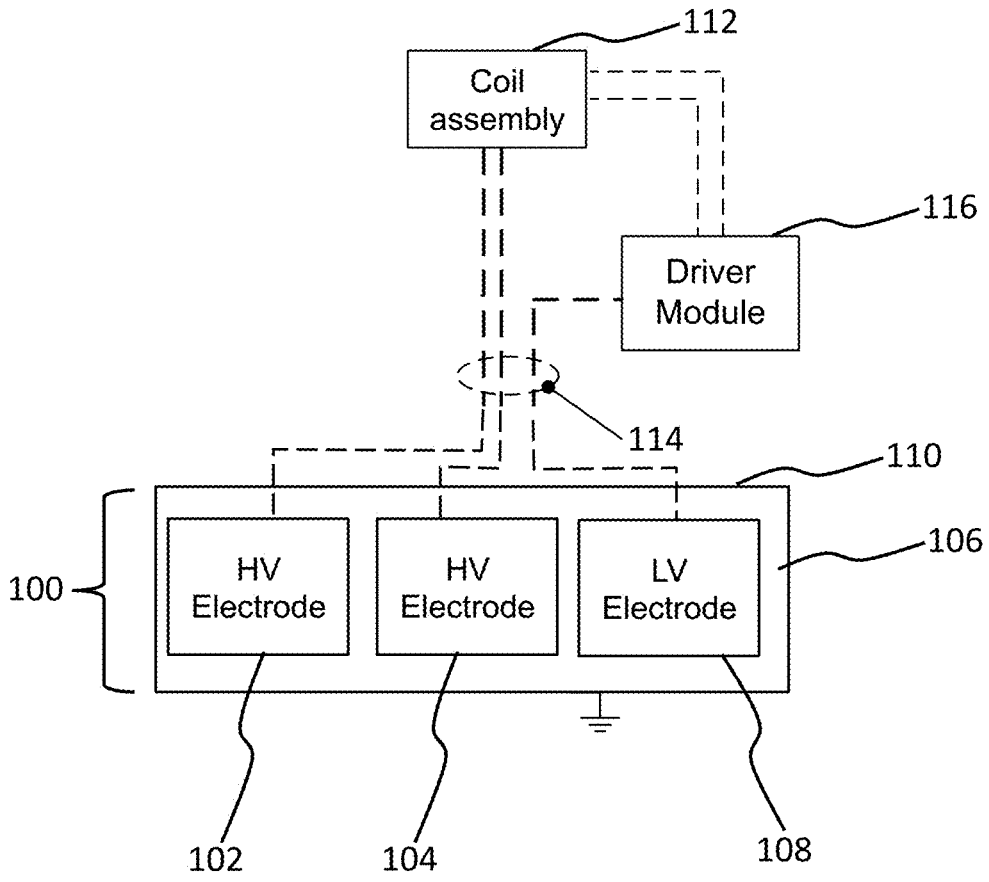
FIG. 1 is a simplified block diagram showing an ignition system according to an embodiment of the invention.

FIG. 1 is a simplified block diagram of an ignition system according to an embodiment of the invention. An igniter 100, e.g., a spark plug, includes a first high voltage (HV) electrode 102 and a second HV electrode 104. The first and second HV electrodes 102 and 104 are elongated and generally rod-shaped, and are embedded in and supported by a support body 106, which is fabricated from an electrically insulating material. The igniter 100 further includes a low voltage (LV) electrode 108. The LV electrode 108 may take various forms including for instance an elongated rod-shaped form or a generally cylindrical-shaped form. The support body 106 electrically isolates the first and second HV electrodes 102 and 104 one from the other, and from the LV electrode 108. The HV electrodes 102 and 104, the LV electrode 108 and the support body 106 are disposed at least partially within a metal case 110, which during use is connected to ground.

Each one of the first and second HV electrodes 102 and 104 is connected to a separate secondary winding (not shown in FIG. 1) of coil assembly 112 via separate resistive wires of high-tension cable 114. The high-tension cable 114 also couples the LV electrode 108 to a feedback circuit (not shown in FIG. 1) of driver module 116 via a non-resistive wire. In the system that is shown in FIG. 1, the LV electrode 108 senses a spark discharge current during a spark event and provides a feedback signal via the non-resistive wire. A driver circuit (not shown in FIG. 1) of the driver module 116 is in communication with the coil assembly 112, for controlling the energizing and discharging of the coil assembly coils based at least partly on the feedback signal. For instance, the feedback signal provides an input of a control algorithm that is used to control the energizing and discharging of the coil assembly coils.

In the specific and non-limiting example that is shown in FIG. 1, the igniter 100 includes two HV electrodes. Optionally, more than two HV electrodes are provided. For instance, between three and eight HV electrodes are provided. For the general case of N >1 HV electrodes, the coil assembly 112 includes N secondary windings and the high-tension cable 114 includes N resistive wires. Only one LV electrode is provided.

Figure 2:
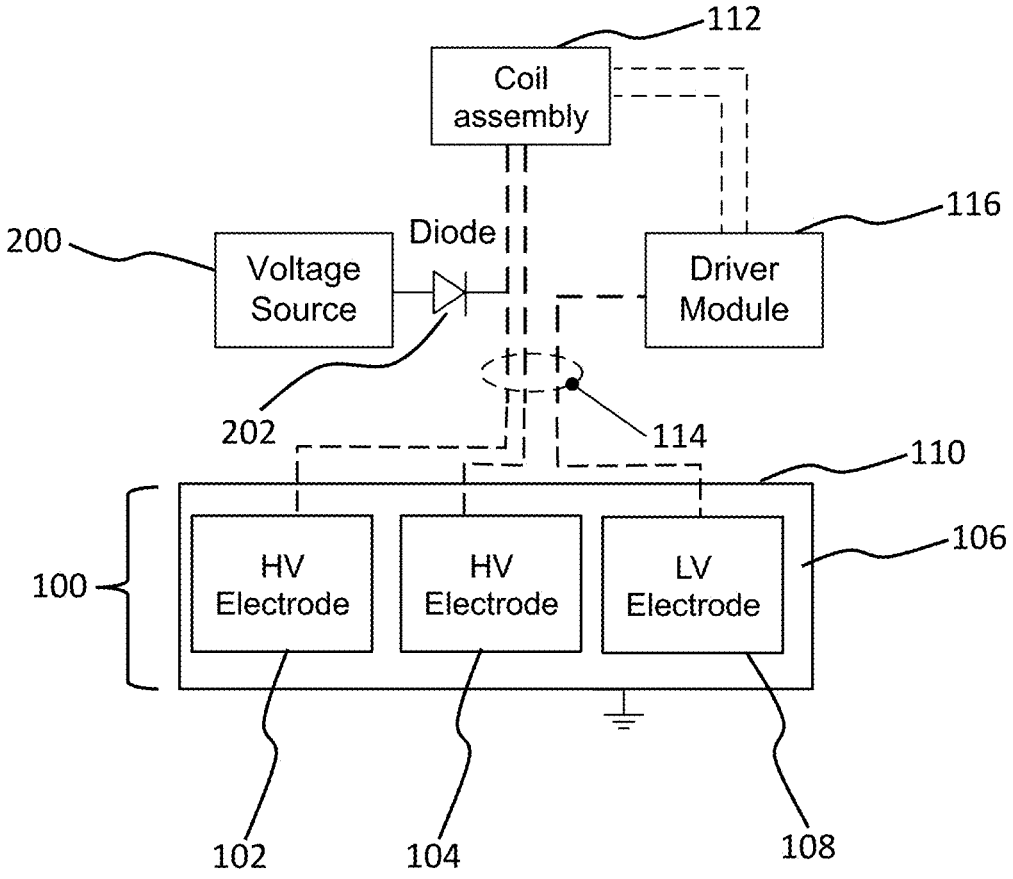
FIG. 2 is a simplified block diagram showing another ignition system according to an embodiment of the invention.

Referring now to FIG. 2, shown is a simplified block diagram of an ignition system according to an embodiment of the invention. Components having the same reference numerals as those described with reference to FIG. 1 have the same function and will not be described again in detail. As such, the system that is shown in FIG. 2 differs from the system that is shown in FIG. 1 in that a voltage source 200 is connected in parallel with at least one of the HV electrodes 102 and 104. The voltage source 200 is a continuous output voltage source providing on the order of several hundred volts. A diode 202 is provided between the voltage source 200 and the HV electrode 102 and/or 104 to prevent interference from the high voltage output of the coil assembly 112. The system of FIG. 2 enables sensing of combustion ion current during operation, providing an additional feedback parameter for use in controlling the energizing and discharging of the coil assembly coils.

Referring now to FIG. 3*a*, shown is a simplified cross-sectional diagram of an igniter having plural rod-shaped HV electrodes and a cylindrical-shaped LV electrode. Each one of the HV electrodes 102 and 104 is provided in the form of a wire-like or rod-shaped electrode that is embedded within the support body 106. The support body 106 is fabricated from an electrically insulating material and serves to electrically isolate the HV electrodes 102 and 104 one from the other. Support body 106 is generally cylindrical in shape, having an enlarged central region forming a ring portion 300, a first generally cylindrical portion 302 extending between the ring portion 300 and a spark forming end of the igniter, and a second generally cylindrical portion 304 extending between the ring portion 300 and the end of the igniter that is opposite the spark forming end. The diameter of the second generally cylindrical portion is larger than the diameter of the first generally cylindrical portion, and the diameter of both the first and second generally cylindrical portions is smaller than the diameter of the ring portion 300. The ring portion 300 is seated on a shoulder feature 306 along an interior surface of metal casing 110. A sealant 308 is provided between the metal casing 110 and the ring portion 300, for retaining the support body 106 and for providing a gas-tight seal.

FIG. 3*b* is a simplified side view showing the cylindrical-shaped LV electrode 108, and FIG. 3*c* is an end view of the cylindrical-shaped LV electrode 108. The LV electrode 108 has an axial channel 312, the support body 106 being disposed at least partially within the axial channel 312 so as to electrically isolate the LV electrode 108 from the first and second HV electrodes 102 and 104. A plurality of slots 310 (shown best in FIG. 3*d*) is defined through an approximately central portion of the LV electrode 108. The support body 106 extends through said slots 310 and completely encircles the approximately central portion of the LV electrode 108 so as to define ring portion 300. As shown in FIG. 3*d*, which is a cross-sectional view taken along line A-A in FIG. 3*a*, the slots 310 extend most of the way around the circumference of the LV electrode 108 within the ring portion 300. Referring again to FIG. 3*a*, the LV electrode 108 is electrically isolated from metal casing 110 by an air gap 312. The air gap results due to the smaller diameter of the support body 106 along the first generally cylindrical portion 302 compared to the diameter of the support body 106 along the second generally cylindrical portion 304. Further, the LV electrode 108 is embedded into the support body 106 within the second generally cylindrical portion, and is electrically insulated from the metal casing 110 by said support body 106. As shown in FIGS. 3*a-c*, projections 314 of the LV electrode 108 extend past the support body 106 at the spark-forming end of the igniter, and cooperate with the HV electrodes 102 and 104 to form first and second spark gaps. Further, a structure 316 is provided on the metal casing 110 for connecting the metal casing 110 to ground. For instance, the structure 316 is an external thread for mating with an internal thread of an engine cylinder block.

Figure 4:
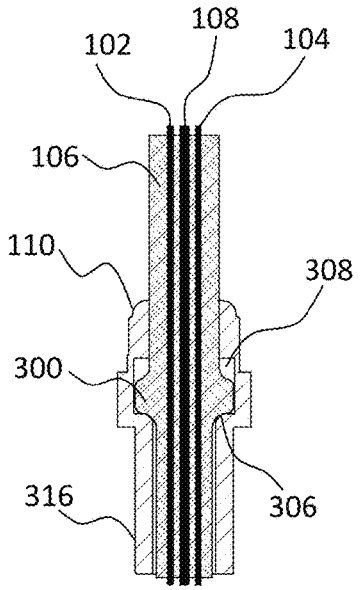
FIG. 4 is a simplified cross-sectional diagram of an igniter having plural rod-shaped HV electrodes and a rod-shaped LV electrode.

Referring now to FIG. 4, shown is a simplified cross-sectional diagram of an igniter having plural rod-shaped HV electrodes 102 and 104 and a rod-shaped LV electrode 108. FIG. 4 is intended to show the relative positions and general shape of the HV electrodes and of the LV electrode in an alternative to the configuration that is shown in FIGS. 3*a-d*. The support body 106 is fabricated from an electrically insulating material. Support body 106 is generally cylindrical in shape, having an enlarged central region forming a ring portion 300. The ring portion 300 is seated on a shoulder feature 306 along an interior surface of the metal casing 110. A sealant 308 is provided between the metal casing 110 and the ring portion 300, for retaining the support body 106 and for providing a gas-tight seal. Further, a structure 316 is provided on the metal casing 110 for connecting the metal casing 110 to ground. For instance, the structure 316 is an external thread for mating with an internal thread of an engine cylinder block.

Referring also to FIGS. 5*a-d*, shown are end views of a plurality of variants of the igniter of FIG. 4. Each one of the FIGS. 5*a-d* shows the generally circular-shaped faces of a plurality of HV electrodes and of an LV electrode, which protrude from the support body 106 at the spark-forming end of the igniter. In each of FIGS. 4 and 5*a-d* the plurality of HV electrodes and the LV electrode are generally rod-shaped, elongated electrode bodies that are supported in a substantially parallel arrangement within the support body 106. The diameter of the LV electrode is optionally larger than the diameter of the HV electrodes. As is shown in FIG. 4, and also with reference to FIGS. 5*a-d*, each of the plurality of HV electrodes and the LV electrode protrudes from the support body 106 by a distance that is sufficient to support the formation of sparks between:

- two or more of the HV electrodes and the LV electrode, and/or
- two of the HV electrodes and at least one of the HV electrodes and the LV electrode.

Depicted in FIGS. 5*a-d* are some specific and non-limiting examples of suitable electrode configurations for the igniter of FIG. 4. For improved clarity the LV electrode has been identified using the label LV but the plural HV electrodes are not labeled. Each one of the HV electrodes is represented using a solid black circle with a white arrow pointing away therefrom. The white arrows in FIGS. 5*a-d* represent sparks, which are formed either between two adjacent HV electrodes or between an HV electrode and the LV electrode. More particularly, the direction of the white arrows in FIGS. 5*a-d* indicates the direction of discharge current with positive HV. Of course, with negative HV the directions of discharge currents are opposite the directions that are shown in FIGS. 5*a-d*.

Figures 5A, 5B, 5C, 5D:
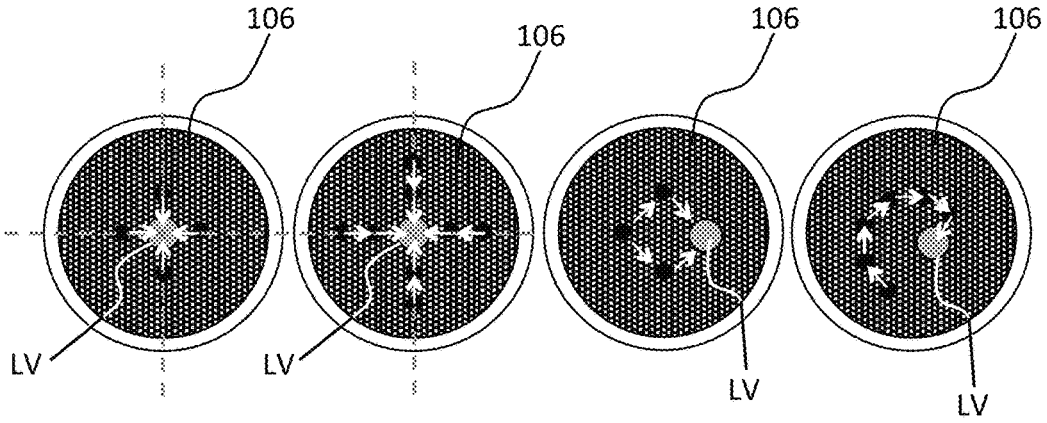
FIG. 5*a* is an end view of a plural HV spark plug having four rod-shaped HV electrodes and a central rod-shaped LV electrode.
FIG. 5*b* is an end view of a plural HV spark plug having eight rod-shaped HV electrodes and a central rod-shaped LV electrode.
FIG. 5*c* is an end view of a plural HV spark plug having three rod-shaped HV electrodes and an off-center rod-shaped LV electrode.
FIG. 5*d* is an end view of a plural HV spark plug having six rod-shaped HV electrodes and a rod-shaped LV electrode arranged in a spiral pattern.

In FIG. 5*a* the LV electrode is disposed substantially centrally within a symmetrical arrangement of HV electrodes. More particularly, for the 4 HV electrodes design, the HV electrodes are arranged at the corners of a square and the LV electrode is at the center of the square, a distance between the LV electrode and each of the HV electrodes being less than a distance between adjacent ones of the HV electrodes. Stated differently, the HV electrodes are disposed along two orthogonal lines (dashed lines in FIG. 5*a*) that intersect substantially at the center of the LV electrode, with a single HV electrode being disposed along each line on each side of the LV electrode. Multiple sparks may be generated either simultaneously or sequentially using the igniter that is depicted in FIG. 5*a*, in particular a spark is formed between each of the HV electrodes and the LV electrode (4 sparks total).

FIG. 5*b* shows a similar arrangement, but having two HV electrodes disposed along each of the lines (dashed lines in FIG. 5*b*) on each side of the LV electrode. In FIG. 5*b* sparks are formed between adjacent outer and inner HV electrodes along the two lines, on each side of the LV electrode, and between the inner HV electrodes and the LV electrodes (8 sparks total). Optionally, the sparks are formed either simultaneously or sequentially. During simultaneous spark generation the sparks are formed between the adjacent outer and inner HV electrodes and between the inner HV electrodes and the LV electrodes at the same time. During sequential spark generation the outer HV electrodes are energized after the inner HV electrodes are energized, and before the end of the spark discharge of the inner HV electrodes.

FIG. 5*c* shows another suitable configuration, in which the LV electrode is disposed off-center relative to three HV electrodes, which are partially symmetrical relative to the LV electrode. In FIG. 5*c* sparks are formed between the HV electrode that is furthest from the LV electrode and each of the two HV electrodes that are closest to the LV electrode, and also between the LV electrode and each of the two HV electrodes that are closest to the LV electrode (4 sparks total). Optionally, the sparks are formed either simultaneously or sequentially. During simultaneous spark generation sparks are formed at the same time between the HV electrode that is furthest from the LV electrode and each of the two HV electrodes that are closest to the LV electrode, and between the LV electrode and each of the two HV electrodes that are closest to the LV electrode. During sequential spark generation the HV electrode that is furthest from the LV electrode is energized after either of the two HV electrodes that are closest to the LV electrode are energized, and before the end of the spark discharge of the two HV electrodes that are closest to the LV electrode.

FIG. 5*d* shows yet another suitable configuration, in which the HV electrodes are arranged along a curved line and the LV electrode is disposed at one end of the curved line. Sparks are formed between adjacent HV electrodes along the curved line and between the LV electrode and the HV electrode that is closest to the LV electrode (6 sparks in this specific example having 6 HV electrodes). The sparks can be generated only in a simultaneous fashion, resulting in a spatially long spark being generated along the path that is illustrated in FIG. 5*d*.

FIGS. 5*a-d* show a non-limiting number of specific examples in which between three and eight HV electrodes are provided. Other configurations are also possible, including configurations having more than eight HV electrodes. Of course each HV electrode is coupled to a separate coil, and accordingly it is the fabrication of the coils that limits the number of HV electrodes in an igniter.

Figure 6:
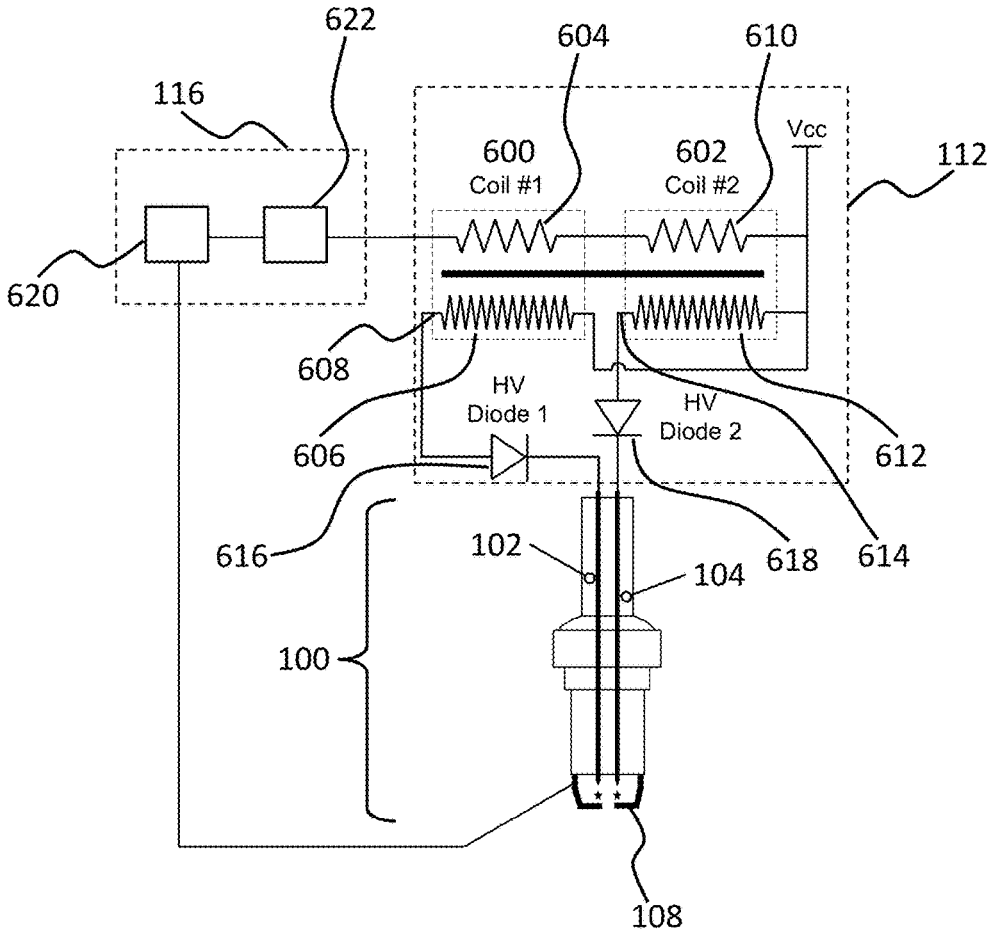
FIG. 6 is a simplified schematic diagram showing an ignition system including series-connected ignition coils coupled to an igniter having plural HV electrodes.

FIG. 6 is a simplified schematic diagram showing an ignition system in which the coil assembly 112 includes series-connected ignition coils 600 and 602 (coil #1 and coil #2) coupled to an igniter 100 having plural HV electrodes 102 and 104 and a cylindrical-shaped LV electrode 108. As shown in FIG. 6, each HV electrode 102 and 104 is connected to a separate ignition coil (coil #1 and coil #2, respectively) through an isolated high voltage cable. Coil #1 600 comprises a first primary winding 604 and a first secondary winding 606, the first secondary winding 606 having a first terminal 608 for providing a first HV signal to HV electrode 102. Coil #2 comprises a second primary winding 610 and a second secondary winding 612, the second secondary winding 612 having a second terminal 614 for providing a second HV signal to the second HV electrode 104. A first high voltage diode 616 (HV Diode 1) is connected between the HV electrode 102 and coil #1 600, and a second HV diode 618 (HV Diode 2) is connected between the HV electrode 104 and coil #2 602 to prevent interference between coils. When the ignition coils 600 and 602 are series connected, as is shown in FIG. 6, the sparking of the two HV electrodes 102 and 104 can be controlled by one driver module 116 with a single command signal, and the timings of the sparks are simultaneous. The driver module 116 comprises feedback circuit 620, which is coupled to the LV electrode 108 for receiving a feedback signal therefrom via the non-resistive wire of the high-tension cable. Driver circuit 622 of the driver module 116 controls the energizing and discharge of coil #1 600 and coil #2 602, based at least partly on the received feedback signal. By way of specific and non-limiting examples, the feedback signal relates to at least one of a sensed spark discharge current and a sensed combustion ion current.

Figure 7:
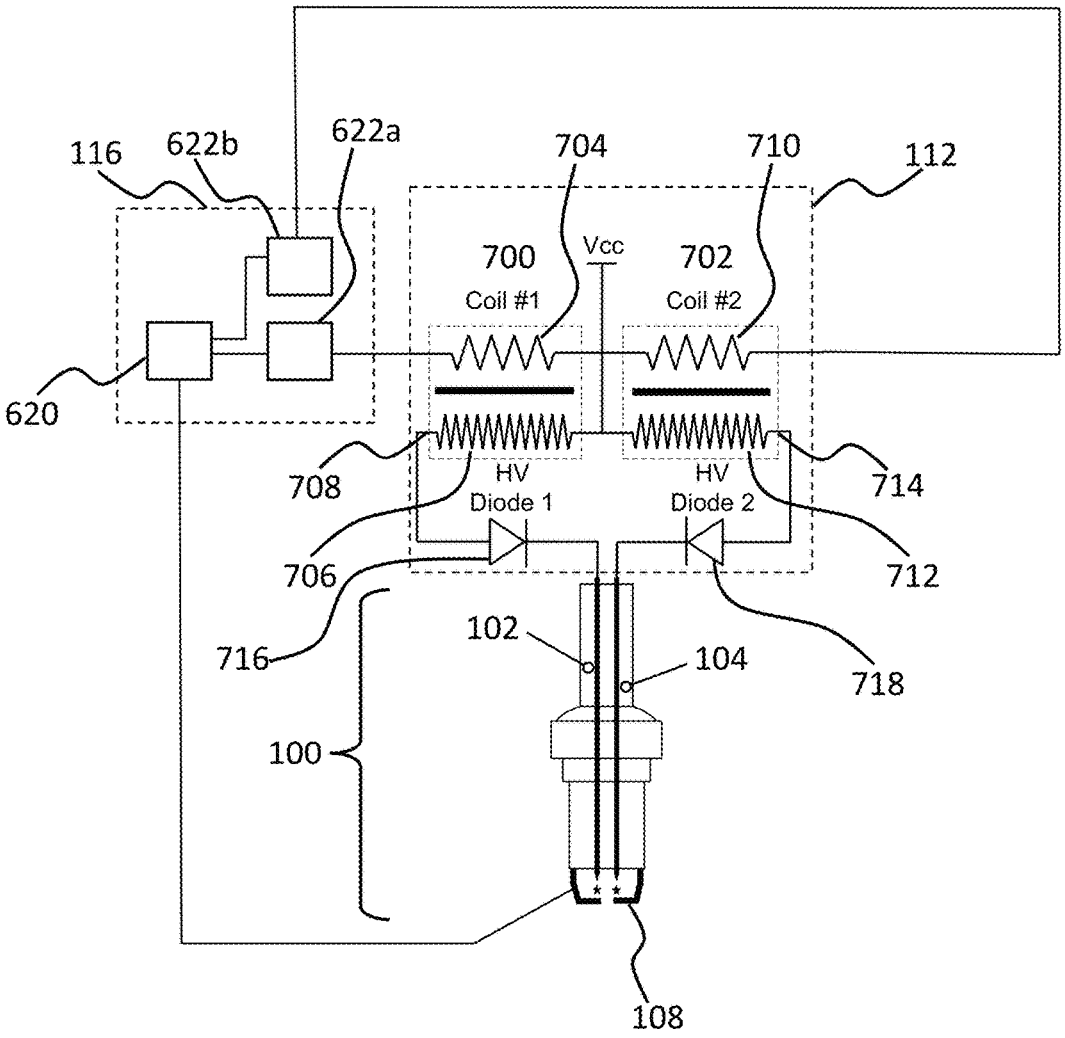
FIG. 7 is a simplified schematic diagram showing an ignition system including parallel-connected ignition coils coupled to an igniter having plural HV electrodes.

FIG. 7 is a simplified schematic diagram showing an ignition system in which the coil assembly 112 includes parallel-connected ignition coils 700 and 702 (coil #1 and coil #2) coupled to an igniter 100 having plural HV electrodes 102 and 104 and a cylindrical-shaped LV electrode 108. As shown in FIG. 7, each HV electrode 102 and 104 is connected to a separate ignition coil (coil #1 and coil #2, respectively) through an isolated high voltage cable. Coil #1 700 comprises a first primary winding 704 and a first secondary winding 706, the first secondary winding 706 having a first terminal 708 for providing a first HV signal to HV electrode 102. Coil #2 702 comprises a second primary winding 710 and a second secondary winding 712, the second secondary winding 712 having a second terminal 714 for providing a second HV signal to the second HV electrode 104. A first high voltage diode 716 (HV Diode 1) is connected between the HV electrode 102 and coil #1 700, and a second HV diode 718 (HV Diode 2) is connected between the HV electrode 104 and coil #2 702 to prevent interference between coils.

When the coils 700 and 702 are parallel connected, the two coils can be driven by one driver module with a single command signal. Alternatively, as shown in FIG. 7, the two coils can be controlled separately using two drivers 622*a* and 622*b* and two command signals. Thus, a sequential sparking mode can be realized for the two HV electrodes 102 and 104 as well as a simultaneous sparking mode, by shifting the spark timing of the two HV electrodes using the two drivers 622*a* and 622*b*. More particularly, the driver module 116 comprises feedback circuit 620, which is coupled to the LV electrode 108 for receiving a feedback signal therefrom via the non-resistive wire of the high-tension cable. Driver circuit 622*a* of the driver module 116 controls the energizing and discharge of coil #1 700, based at least partly on the received feedback signal. Similarly, driver circuit 622*b* of the driver module 116 controls the energizing and discharge of coil #2 702, based at least partly on the received feedback signal. By way of specific and non-limiting examples, the feedback signal relates to at least one of a sensed spark discharge current and a sensed combustion ion current.

Figure 8:
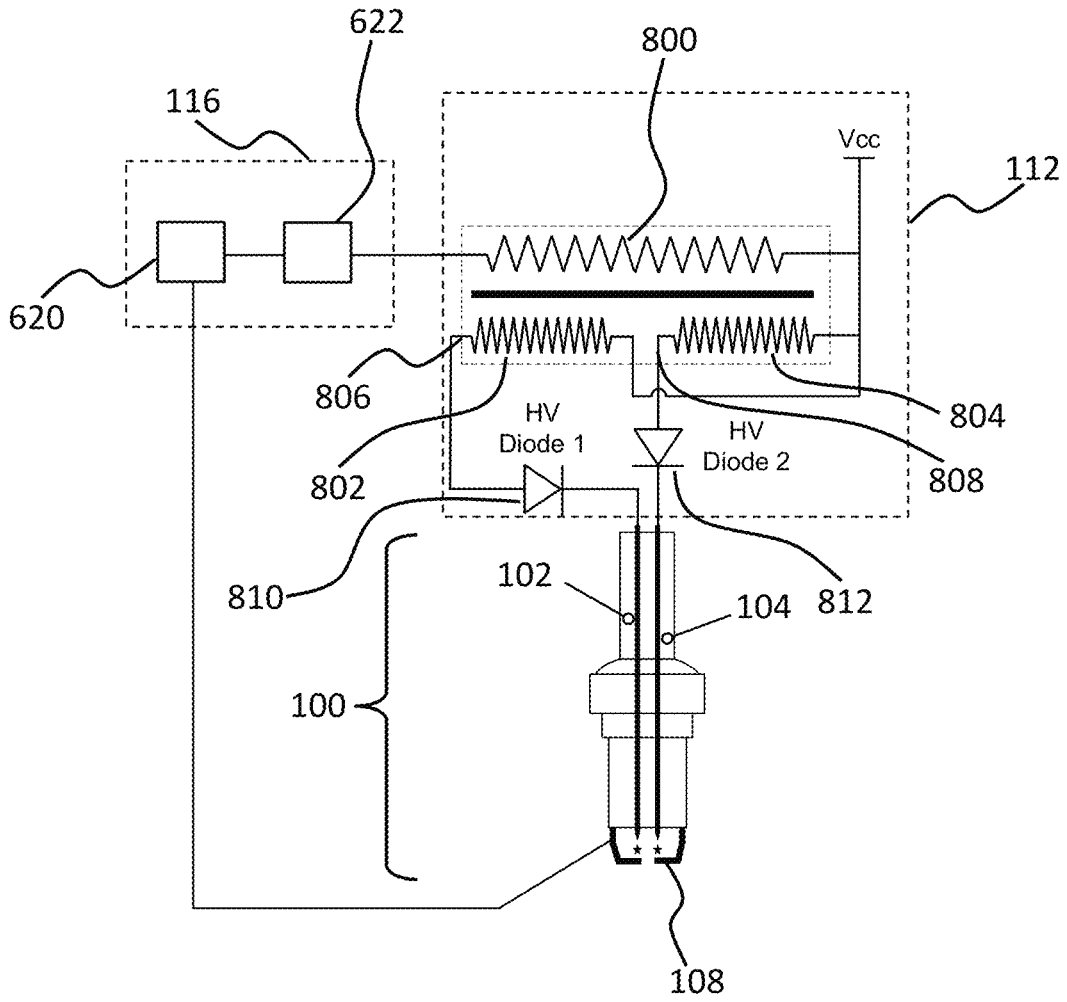
FIG. 8 is a simplified schematic diagram showing an ignition system including a common primary winding and plural secondary windings coupled to an igniter having plural HV electrodes.

FIG. 8 is a simplified schematic diagram showing an ignition system in which the coil assembly 112 includes a common primary winding 800 and plural secondary windings 802 and 804, which are coupled to an igniter having plural HV electrodes 102 and 104 and a cylindrical-shaped LV electrode 108. As shown in FIG. 8, each HV electrode 102 and 104 is connected to a separate secondary winding 802 and 804, respectively, of the coil assembly 112 through an isolated high voltage cable. The secondary windings 802 and 804 share one end at low voltage. The secondary winding 802 has a first terminal 806 for providing a first HV signal to HV electrode 102. Similarly, the secondary winding 804 has a second terminal 808 for providing a second HV signal to the second HV electrode 104. A first high voltage diode 810 (HV Diode 1) is connected between the HV electrode 102 and secondary winding 802, and a second HV diode 812 (HV Diode 2) is connected between the HV electrode 104 and secondary winding 804 to interference between coils. When the coil assembly 112 includes a common primary winding 800, the sparking of the two HV electrodes 102 and 104 can be controlled by a single driver module 116 with a single command signal, and the timings of the sparks are simultaneous. The driver module 116 comprises feedback circuit 620, which is coupled to the LV electrode 108 for receiving a feedback signal therefrom via the non-resistive wire of the high-tension cable. Driver circuit 622 of the driver module 116 controls the energizing and discharge of coil assembly 112, based at least partly on the received feedback signal. By way of some specific and non-limiting examples, the feedback signal relates to at least one of a sensed spark discharge current and a sensed combustion ion current.

Figure 9A:
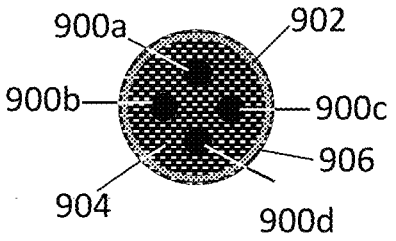
FIG. 9*a* is a cross-sectional view of a high-tension cable having four resistive wires and an annular low voltage wire.

FIG. 9*a* is a cross-sectional view showing a first high-tension cable design having four resistive wires 900*a-d* and an annular non-resistive (low voltage) wire 902. An electrically insulating material 904 isolates the resistive wires 900*a-d* one from another and from the annular non-resistive wire 902. An insulation layer 906 is provided along the outside of the high-tension cable.

Figure 9B:
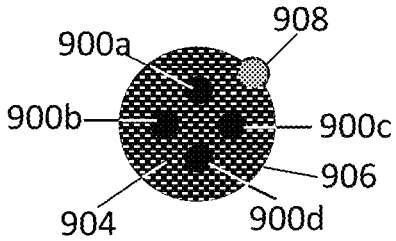
FIG. 9*b* is a cross-sectional view of a high-tension cable having four resistive wires and an off-center low voltage wire.

FIG. 9*b* is a cross-sectional view showing a second high-tension cable design having four resistive wires 900*a-d* and an off-center non-resistive (low voltage) wire 908. An electrically insulating material 904 isolates the resistive wires 900*a-d* one from another and from the off-center non-resistive wire 902. An insulation layer 906 is provided along the outside of the high-tension cable.

Figure 9C:
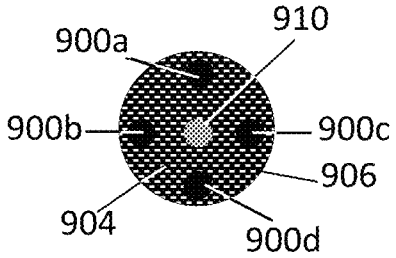
FIG. 9*c* is a cross-sectional view of a high-tension cable having four resistive wires and a central low voltage wire.

FIG. 9*c* is a cross-sectional view showing a third high-tension cable design having four resistive wires 900*a-d* and a central (non-resistive) low voltage wire 910. An electrically insulating material 904 isolates the resistive wires 900*a-d* one from another and from the central non-resistive wire 910. An insulation layer 906 is provided along the outside of the high-tension cable.

Figure 10:
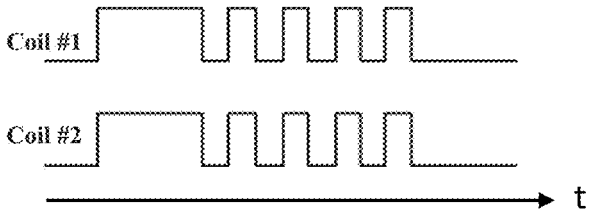
FIG. 10 is a timing diagram for a pair of coils operating in a simultaneous discharge mode.
Figure 11:
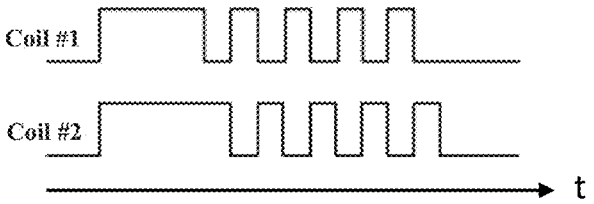
FIG. 11 is a timing diagram for a pair of coils operating in a sequential discharge mode.

The ignition systems that are described in the preceding paragraphs, in particular with reference to FIGS. 1, 2 and 6-8, provide multiple spark discharge channels; each HV electrode 102 and 104 is connected to the HV terminal of a separate secondary winding of coil assembly 112 via an isolated high-tension cable. Three main spark discharge modes can be realized by the ignition system. In a first mode each coil generates a single discharge, and all of the discharges are scheduled at the same timing such that the total spark energy of a single spark event is multiplied. In a second mode each coil generates multiple event discharges, and all of the discharges are scheduled at the same timings as illustrated in the timing diagram that is shown in FIG. 10. In a third mode each coil generates multiple event spark discharges, and each coil discharges at an interval of the charging process of the other coil(s) as illustrated in the timing diagram that is shown in FIG. 11, thereby providing substantially continuous discharge around the spark gap.

Figure 12:
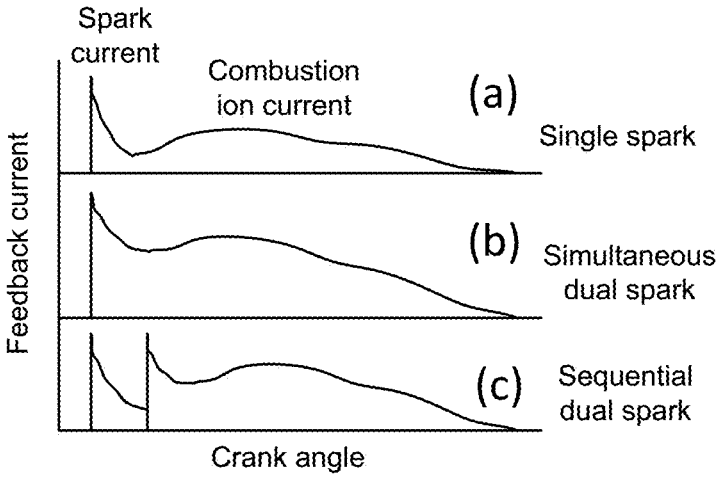
FIG. 12 shows the sensed spark current and combustion ion current for a single spark mode, a simultaneous dual spark mode, and a sequential dual spark mode.

Referring now to FIG. 12, shown are plots of sensed feedback current vs. crank angle. The system of FIG. 1 uses the LV electrode to sense spark current as an input into a control algorithm for energizing and discharging the coils of coil assembly 116. The system of FIG. 2 includes a voltage source connected in parallel with at least one of the HV electrodes, which permits the sensing of combustion ion current as an input into a control algorithm for energizing and discharging the coils of coil assembly 116. FIG. 12*a* illustrates feedback current for a single spark mode of operation, according to the prior art. FIG. 12*b* illustrates feedback current for a simultaneous dual (or multi) spark mode of operation, such as for instance forming a spark between HV electrode 102 and LV electrode 108 and simultaneously forming a spark between HV electrode 104 and LV electrode 108 using the igniter of FIG. 3 or 4. As shown in FIG. 12*b* higher spark current and combustion ion current is observed. FIG. 12*c* illustrates feedback current for a sequential dual (or multi) spark mode of operation, such as for instance forming a spark between HV electrode 102 and LV electrode 108 and then subsequently (in sequence) forming a spark between HV electrode 104 and LV electrode 108 using the igniter of FIG. 3 or 4.

The feedback currents are sensed using LV electrode 108, and provide a feedback signal that may be used as an input to a control algorithm implemented by the driver module 116. The spark discharge current is fed back for use in detecting spark malfunctions such as insufficient current delivery and spark blow-off etc., providing information of air/fuel ratio and gas motion. The duration of spark current, peak of spark current, and the first or/and the second order differential of spark current profile are calculated from the sensed spark current signal. Based on pre-calibrated correlations between the spark current parameters and the mixture parameters, information of gas motion, air/fuel mixture strength can be obtained, providing a database for decision making of driver module 116. The combustion ion current is fed back for use in diagnosing combustion processes, and detecting misfire, etc.

In the ignition systems that are described above, in order to prevent breakdown between the HV electrodes the design parameters for each HV electrode and the attached high voltage cable and ignition coil should be substantially identical. For instance, the coil specifications, the length and the impedance of the high voltage cable, and the gap size between the HV electrodes and the low voltage electrode should be substantially identical.

Of course, the ignition systems and igniters that are described above with reference to FIGS. 1-12 are useful for spark ignited internal combustion engines operating under conditions with lean or diluted in-cylinder charge, and/or conditions with stratified charge. The ignition systems and igniters are also suitable for use in other types of combustion engines or burners, which require an ignition source to initiate combustion.

While the above description constitutes a plurality of embodiments of the invention, it will be appreciated that the present invention is susceptible to further modification and change without departing from the fair meaning of the accompanying claims.

What is claimed is:

1. An igniter for a spark ignition system, comprising:

a support body fabricated from an electrically insulating material;

a metal casing disposed outwardly of and at least partially surrounding the support body, the metal casing having a structure for connecting the metal casing to ground;

at least two rod-shaped first electrodes supported one relative to another by the support body and electrically isolated one from the other by the support body, each first electrode of the at least two first electrodes having a first end that protrudes from a first end of the support body at a spark forming end of the igniter; and a generally cylindrically-shaped second electrode having an axial channel, the support body being disposed at least partly within the axial channel, the second electrode projecting past the support body at the spark forming end of the igniter and cooperating with the first ends of the at least two first electrodes to define at least two spark gaps, the second electrode further being electrically isolated from the metal casing by an air gap;

wherein during use the first electrodes receive a first voltage that is higher than ground and the second electrode receives a second voltage that is lower than the first voltage; and wherein during use a first spark is formed within a first one of the at least two spark gaps and a second spark is formed within a second one of the at least two spark gaps.

2. The igniter according to claim 1 wherein the structure for connecting the metal casing to ground comprises an external thread for mating with an internal thread of an engine cylinder block.

3. The igniter according to claim 1 wherein slots are defined through portions of the second electrode, and wherein the support body extends through the slots and forms a ring portion that encircles the second electrode, the ring portion engaging a shoulder feature along an inner surface of the metal casing.

4. The igniter according to claim 3 wherein the support body comprises a first generally cylindrical portion extending between the ring portion and the first end of the support body and a second generally cylindrical portion extending between the ring portion and a second end of the support body that is opposite the first end, the diameter of the second generally cylindrical portion larger than the diameter of the first generally cylindrical portion.

5. The igniter according to claim 4 wherein the air gap is a generally annular space that is formed between the metal casing and the first generally cylindrical portion of the support body.

6. The igniter according to claim 4 wherein the second electrode is embedded within the second generally cylindrical portion of the support body.

7. The igniter according to claim 4 comprising a sealant material disposed between the ring portion of the support body and the metal casing, the sealant material forming a gas tight seal at one end of the air gap.

8. An igniter for a spark ignition system, comprising:

a support body fabricated from an electrically insulating material;

a metal casing disposed outwardly of and at least partially surrounding the support body, the metal casing having a structure for connecting the metal casing to ground;

at least two first electrodes and a second electrode, the at least two first electrodes being electrically isolated one from the other and from the second electrode, each one of the at least two first electrodes and the second electrode being a generally rod-shaped electrode supported by the support body and each one of the at least two first electrodes and the second electrode having a first end that protrudes from the support body at the spark forming end of the igniter, wherein during use the first electrodes receive a first voltage that is higher than ground and the second electrode receives a second voltage that is lower than the first voltage; and wherein the at least two first electrodes and the second electrode are disposed one relative to another and protrude from the support body by a distance that is sufficient to form, during a spark event, a plurality of sparks therebetween.

9. The igniter according to claim 8 wherein the at least two first electrodes are disposed relative to one another and relative to the second electrode, such that during use a first spark is formed between the first end of a first one of the at least two first electrodes and the first end of the second electrode, and such that during use a second spark is formed between the first end of a second one of the at least two first electrodes and the first end of the second electrode.

10. The igniter according to claim 8 wherein the at least two first electrodes are disposed relative to one another and relative to the second electrode, such that during use a first spark is formed between the first end of a first one of the at least two first electrodes and the first end of a second one of the at least two first electrodes, and such that a second spark is formed between the first end of the second one of the at least two first electrodes and the first end of the second electrode.

11. The igniter according to claim 8 wherein the second electrode is disposed approximately centrally with respect to a symmetrical arrangement of the at least two first electrodes.

12. The igniter according to claim 8 wherein the at least two first electrodes are disposed along two orthogonal lines, the two orthogonal lines intersecting approximately at the center of the first end of the second electrode.

13. The igniter according to claim 12 wherein plural first electrodes are disposed along each of the two orthogonal lines on each opposite side of the second electrode, such that during use first sparks are formed between outer and inner first electrodes and second sparks are formed between inner first electrodes and the second electrode.

14. The igniter according to claim 8 wherein the second electrode is disposed other than approximately centrally with respect to an arrangement of the at least two first electrodes.

15. The igniter according to claim 8 wherein the second electrode is disposed relative to the at least two first electrodes such that during use a first spark is formed between a first one of the at least two first electrodes and a second one of the at least two first electrodes and a second spark is formed between the second one of the at least two first electrodes and the second electrode.

16. The igniter according to claim 8 wherein the at least two first electrodes and the second electrode are disposed along a curved line and the second electrode is disposed at one end of the curved line, such that during use a spark is formed between each pair of adjacent first electrodes in the line and between the second electrode and the one of the first electrodes that is closest thereto.

17. The igniter according to claim 16 wherein the curved line forms a part of a spiral.

* * * * *